US008646856B2

(12) United States Patent
Park et al.

(10) Patent No.: US 8,646,856 B2
(45) Date of Patent: Feb. 11, 2014

(54) BOTTOM-MOUNTED SLIDE AND MANUFACTURING METHOD THEREOF

(75) Inventors: Yoon Sik Park, Seoul (KR); Hyun Ho Cha, Kyeonggi-do (KR)

(73) Assignee: Segos Co., Ltd., Incheon (KR)

( * ) Notice: Subject to any disclaimer, the term of this patent is extended or adjusted under 35 U.S.C. 154(b) by 315 days.

(21) Appl. No.: 12/994,779

(22) PCT Filed: Jul. 28, 2009

(86) PCT No.: PCT/KR2009/004183
§ 371 (c)(1),
(2), (4) Date: Nov. 26, 2010

(87) PCT Pub. No.: WO2010/013924
PCT Pub. Date: Feb. 4, 2010

(65) Prior Publication Data

US 2011/0123138 A1 May 26, 2011

(30) Foreign Application Priority Data

Jul. 28, 2008 (KR) ..... 10-2008-0073314

(51) Int. Cl.
*A47B 88/04* (2006.01)

(52) U.S. Cl.
USPC ..... 312/334.33; 312/334.1

(58) Field of Classification Search
USPC ..... 312/334.6, 334.11, 334.14, 334.15, 312/334.17, 334.38, 330.1, 334.1, 334.7, 312/334.8, 334.16, 334.25, 334.26, 334.33, 312/334.37; 384/18
See application file for complete search history.

(56) References Cited

U.S. PATENT DOCUMENTS

| | | | | |
|---|---|---|---|---|
| 4,194,793 | A * | 3/1980 | Offermans | 384/18 |
| 4,569,563 | A * | 2/1986 | Fourrey | 384/49 |
| 4,606,588 | A * | 8/1986 | Koch | 384/18 |
| 4,752,142 | A * | 6/1988 | Jackson et al. | 384/18 |
| 5,417,489 | A * | 5/1995 | Compagnucci | 312/334.11 |
| 6,132,020 | A * | 10/2000 | Schael et al. | 312/334.1 |
| 2008/0157643 | A1 * | 7/2008 | Chen | 312/334.6 |
| 2009/0195131 | A1 * | 8/2009 | Chi et al. | 312/319.1 |

FOREIGN PATENT DOCUMENTS

EP 0 406 647 A2 1/1991

OTHER PUBLICATIONS

Machine Translation of EP 0406647, Jan. 9, 1991.*
Extended European Search Report dated for EP 09 80 3129 (which is a counterpart foreign application).

* cited by examiner

*Primary Examiner* — Darnell Jayne
*Assistant Examiner* — Sasha T Varghese
(74) *Attorney, Agent, or Firm* — The PL Law Group, PLLC

(57) ABSTRACT

The present invention relates to a bottom-mounted slide. The bottom-mounted slide includes a movable member, stationary members and a ball housings. First raceways are formed in both lateral sides of the movable member. Each stationary member has second raceways which are respectively connected to the first raceways by corresponding balls to guide the movable member. The balls roll along the corresponding first and second raceways. The ball housings are provided between the movable member and each of the stationary members. The ball housings support the balls. A depressed part is provided in a predetermined portion of each of the lateral sides of the movable member between the corresponding first raceways. The depressed part is inserted into a hollow space defined inside the first raceways of the corresponding end of the movable member. Therefore, the stability can be increased by improvement of roll-forming and reduction of horizontal moment.

17 Claims, 6 Drawing Sheets

BOTTOM-MOUNTED SLIDE AND MANUFACTURING METHOD THEREOF

CROSS REFERENCE TO RELATED APPLICATION

The present application claims priority to International Application PCT/KR2009/004183, with an International Filing Date of Jul. 28, 2009, which claims the benefit of Korean patent application No. 10-2008-0073314 filed in the Korea Intellectual Property Office on Jul. 28, 2008, the entire contents of which are incorporated herein by reference.

BACKGROUND OF THE INVENTION

1. Field of the Invention

The present invention relates generally to bottom-mounted slides and methods of manufacturing the slides and, more particularly, to a bottom-mounted slide which is slid by balls which roll between a movable member and a stationary member.

2. Description of the Related Art

Generally, bottom-mounted slides are provided between drawers and bodies of, e.g., desks, to enable users to easily open or close the drawers. For example, in the case of a three-stage folding style bottom-mounted slide, a stationary member is fastened to a sidewall or bottom plate of a drawer by an extension. A movable member is fastened to a lower surface of a bottom plate of a desk. Three raceways are formed in each of both lateral sides of an intermediate member. Furthermore, a plurality of balls is located between the stationary member and the intermediate member and between the movable member and the intermediate member. The balls roll along the raceways. Thereby, the intermediate member slides along the stationary member, and the movable member slides along the intermediate member.

FIG. 1 is a sectional view showing a conventional bottom-mounted slide 10 disclosed in U.S. Pat. No. 6,132,020. As shown in FIG. 1, the conventional bottom-mounted slide 10 includes a movable member 13, a stationary member 17 and an intermediate member 14 which is interposed between the movable member 13 and the stationary member 17.

In the conventional bottom-mounted slide 10, the stationary member 17 is fastened to a sidewall panel 16 of a body of, for example, a desk, and the movable member 13 is fastened to the lower surface of a drawer panel 11. Three raceways are formed on each of lateral sides of the intermediate member 14.

Balls 15 are provided between the movable member 13 and the intermediate member 14 and between the intermediate member 14 and the stationary member 17. The balls 15 roll along the corresponding raceways so that the intermediate member 14 slides along the stationary member 17 and the movable member 13 slides along the intermediate member 14. As such, the slide 10 is generally operated in a three-stage folding manner.

However, in the conventional bottom-mounted slide 10 disclosed in U.S. Pat. No. 6,132,020, because the width of the movable member 13 is relatively small, its stability with respect to rotational moment is markedly reduced when a comparatively high load is applied to the slide 10.

In an effort to overcome these problems, the applicant of the present invention proposed a wide-width style bottom-mounted slide in Korean Patent Application No. 2007-17214. As shown in FIG. 2, the slide 100 of No. 2007-17214 includes a first member 130 which substantially supports a load. Triangular raceway forming parts are respectively provided on the lateral sides of the first member 130. An extension 145 which is oriented in the vertical direction is provided between the triangular raceway forming parts. A horizontal web is longer than a lateral web.

The conventional slide 100 can increase the stability with respect to the rotational moment when a comparatively high load is applied thereto. However, the conventional slide 100 is problematic in that a defective proportion of movable members produced by roll-forming increases and, in particular, there is a comparatively high proportion of defective raceway forming parts formed by roll-forming.

SUMMARY OF THE INVENTION

Accordingly, the present invention has been made keeping in mind the above problems occurring in the prior art, and an object of the present invention is to provide a bottom-mounted slide which can reduce a proportion of defectives formed by roll-forming compared to the conventional bottom-mounted slide.

Another object of the present invention is to provide a bottom-mounted slide in which the volume of hollow spaces formed in a movable member can be minimized, thus enhancing the strength of the slide.

A further object of the present invention is to provide a bottom-mounted slide in which symmetric depressed parts are provided in both lateral sides of the movable member so that the depressed parts are resistant to compression force applied to the slide, thus improving the stability of the slide.

A still another object of the present invention is to provide a bottom-mounted slide which can be used to support a comparatively high load.

In order to accomplish the above object, in an aspect, the present invention provides a bottom-mounted slide, including: a movable member, with a plurality of first raceways formed in both lateral sides of the movable member; stationary members each of which has a plurality of second raceways, the second raceways being respectively connected to the first raceways by corresponding balls to guide the movable member, the balls rolling along the corresponding first and second raceways; a ball housing provided between the movable member and each of the stationary members, the ball housing supporting the balls. A depressed part is provided in a predetermined portion of each of the lateral sides of the movable member between the corresponding first raceways. The depressed part is inserted into a hollow space defined inside the first raceways of the corresponding end of the movable member.

In this embodiment, the depressed part may have a U shape.

The movable member may include a horizontal web and a lateral web, the horizontal web being longer than the lateral web.

The depressed part may be aligned with a lateral axis of the movable member.

The depressed part may be formed at a medial portion between the corresponding first raceways.

In another aspect, the present invention provides a method of manufacturing a movable member for a bottom-mounted slide, including: forming a depressed part in a predetermined portion of each of horizontal webs provided on both lateral sides of the movable member, the depressed part being inserted into a hollow space formed inside the corresponding horizontal web; and forming raceways in the respective lateral sides of the movable member, the raceways coming into contact with rolling balls.

In this embodiment, the depressed part may have a U shape.

Furthermore, the movable member may include the horizontal web and a lateral web, the horizontal web being longer than the lateral web.

The forming of the depressed part may comprise aligning the depressed part with a lateral axis of the movable member.

The forming of the depressed part may comprise forming the depressed part at a medial portion between the corresponding raceways.

In the bottom-mounted slide according to the present invention, the proportion of defectives formed by roll-forming can be reduced, compared to the conventional bottom-mounted slide.

Furthermore, the volume of hollow spaces formed in a movable member can be minimized, thus enhancing the strength of the slide.

In addition, symmetric depressed parts are provided in both lateral sides of the movable member so that the depressed parts are resistant to compression force applied to the slide, thus improving the stability of the slide.

Moreover, the bottom-mounted slide can be used to support a comparatively high load.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE ELEMENTS IN THE DRAWINGS

Figure 1:
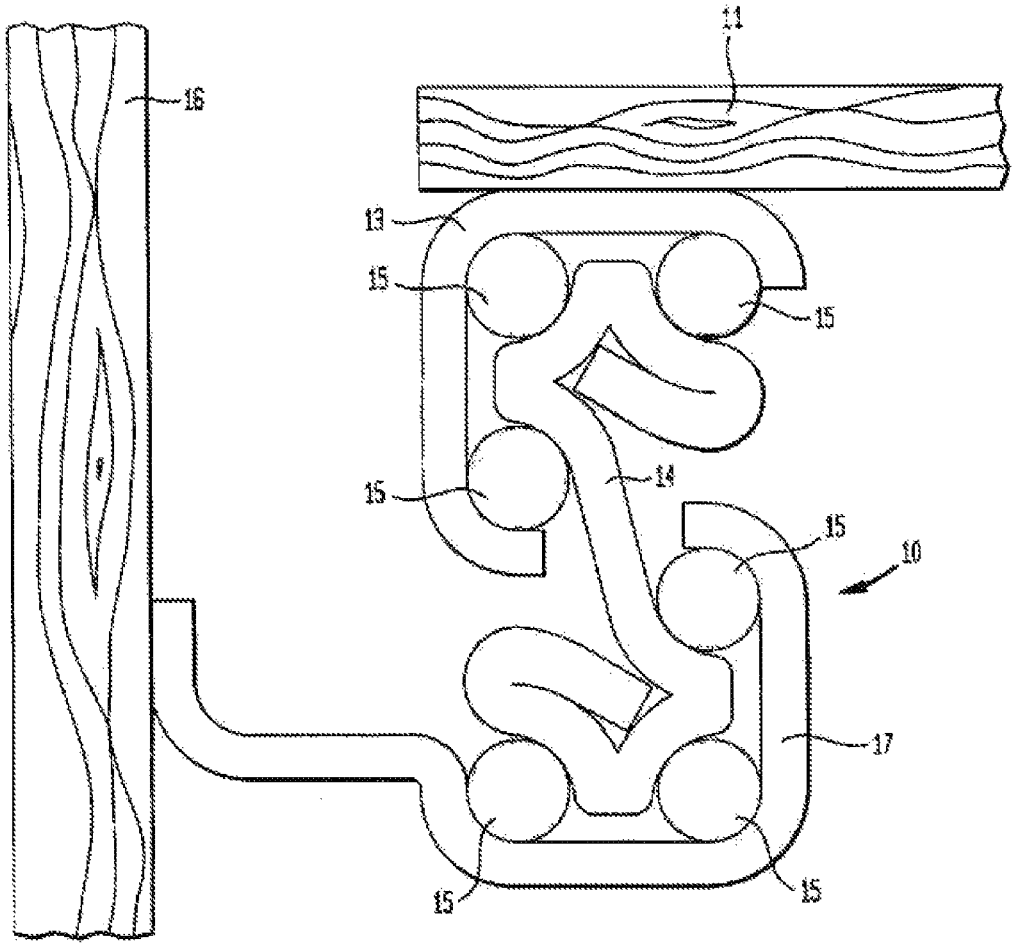
PRIOR ART FIG. 1
FIG. 1 is a sectional view showing a conventional bottom-mounted slide.
Figure 2:
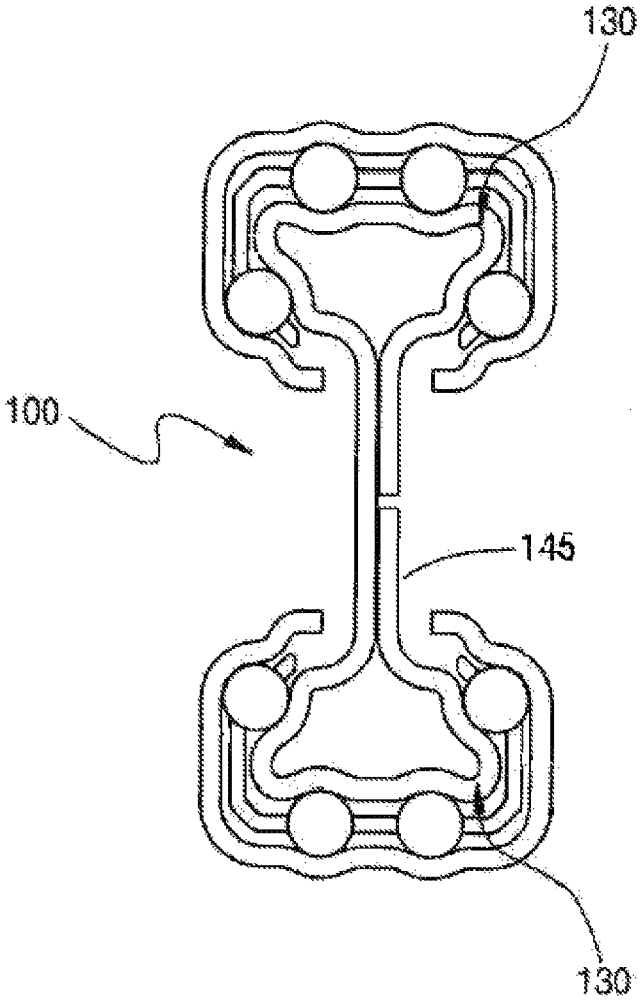
PRIOR ART FIG. 2
FIG. 2 is a sectional view showing a conventional wide-width style bottom-mounted slide.

| *Description of the elements in the drawings* | |
|---|---|
| 30: bottom-mounted slide | 32: stationary member |
| 33: second raceway | 34: ball retainer |
| 36: horizontal web | 37: first raceway |
| 38: lateral web | 39: ball |
| 40: depressed part | 45: raceway part |
| 47: hollow space | |

DESCRIPTION OF THE PREFERRED EMBODIMENTS

Hereinafter, a bottom-mounted slide according to a preferred embodiment of the present invention will be described in detail with reference to the attached drawings.

Figure 3:
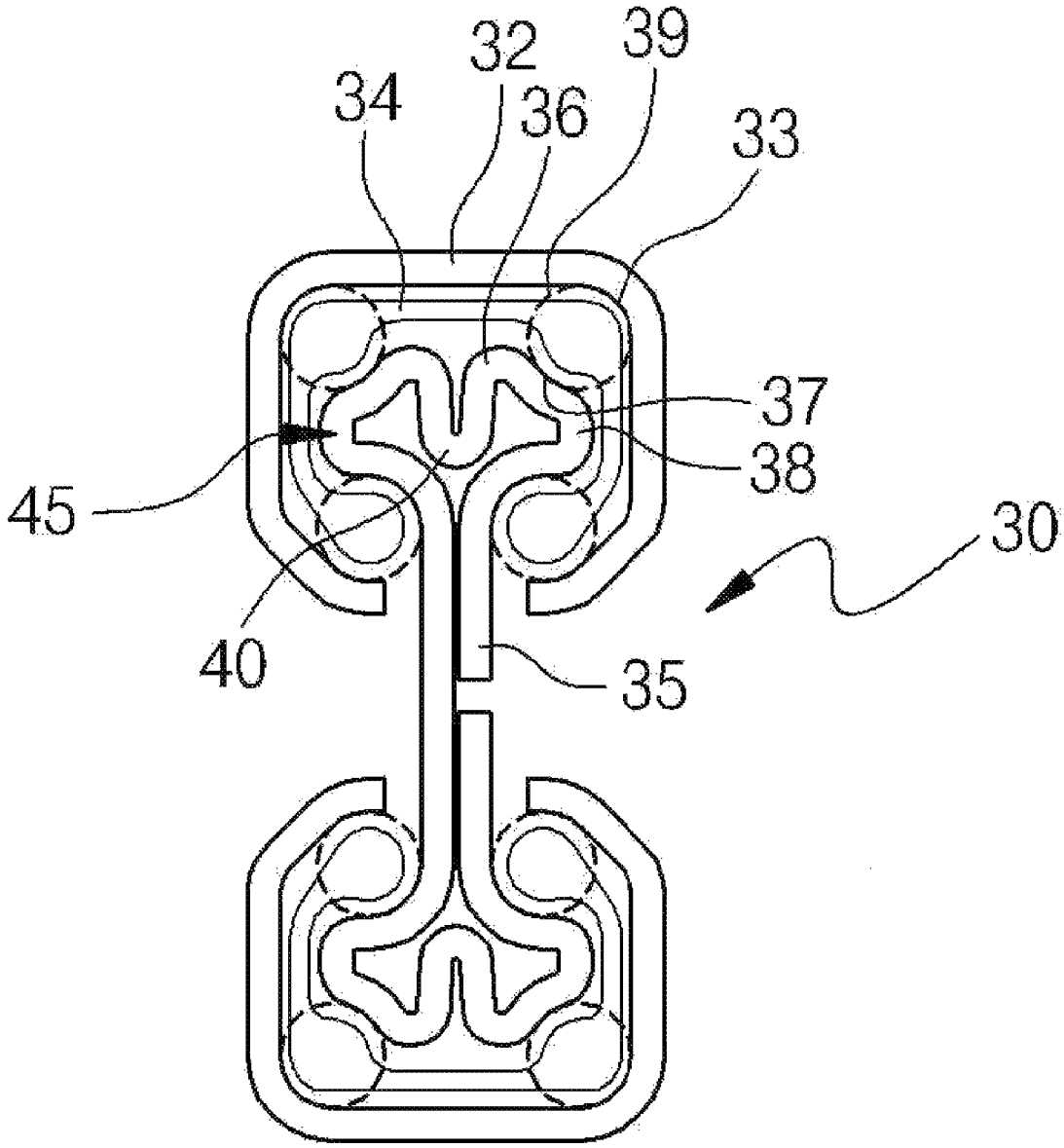
FIG. 3 is a sectional view of a bottom-mounted slide, according to an embodiment of the present invention.
Figure 4:
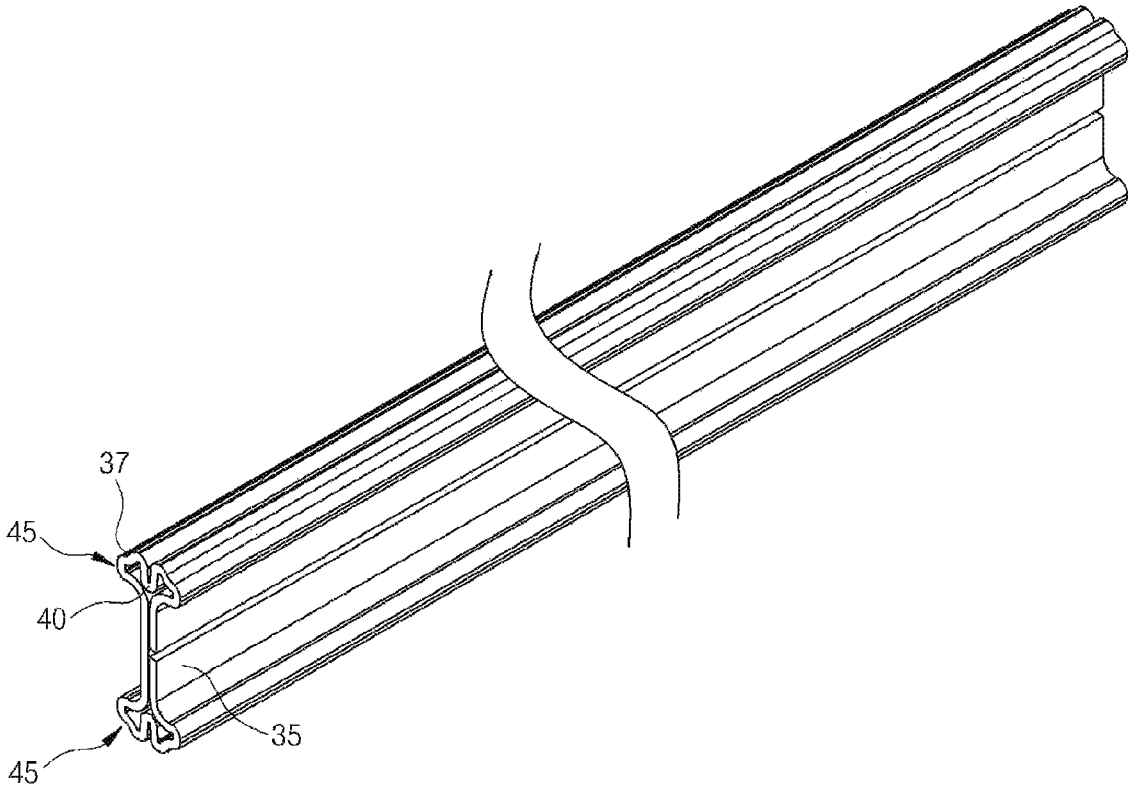
FIG. 4 is a perspective view showing a movable member of the bottom-mounted slide according to the present invention.

FIG. 3 is a sectional view of the bottom-mounted slide 30, according to the embodiment of the present invention. FIG. 4 is a perspective view showing a movable member 35 of the bottom-mounted slide 30 according to the present invention. As shown in FIG. 3, the bottom-mounted slide 30 includes a movable member 35, stationary members 32 and reception members 34. A plurality of first raceways 37 is formed on each of both lateral sides of the movable member 35. Each stationary member 32 has a plurality of second raceways 33 which are respectively connected to the first raceways 37 by corresponding balls 39 to guide the movable member 35. The balls 39 roll between the corresponding first and second raceways 37 and 33. Each ball housing 34 is provided between the movable member 35 and the corresponding stationary member 32 and houses the balls 39 therein. In the embodiment, a ball retainer which has a width greater than that of the conventional ball retainer is used as the ball housing 34.

In the bottom-mounted slide 30 of the present invention, a U-shaped depressed part 40 is provided in a predetermined portion of each end of the movable member 35 between the corresponding first raceways 37 such that the interior of the movable member 35 is filled with the depressed part 40.

Therefore, the bottom-mounted slide 10 has a wide-width structure such that a horizontal web of the movable member 35 is longer than a lateral web thereof. Furthermore, a proportion of defectives formed by roll-forming can be reduced, and the volume of a hollow space 47 formed in each of the lateral sides of the movable member 35 is minimized by the U-shaped depressed part 40. Thus, the strength of the movable member 35 can be enhanced so that it can be used to support a comparatively high load.

The movable member 35 includes raceway parts 45. Each raceway part 45 includes the first raceways 37 which are formed at position corresponding to the corresponding second raceways 33 of the stationary member 32. The raceway part 45 further includes webs 36 and 38 which are provided between the first raceways 37. The webs 36 and 38 comprise a horizontal web 36 and a lateral web 38. The horizontal web 36 is longer than the lateral web 38.

In the movable member 35 of the present invention, the depressed part 40 is formed in the horizontal web 36. Here, the depressed part 40 is inserted into the hollow space 47 formed in the movable member 35.

Of course, as shown in FIG. 3, it is desirable that the depressed part 40 has a U-shape which has no portion on which stress is concentrated unlike a V-shaped structure in which stress is concentrated on the lower end thereof. However, the shape of the depressed part 40 is not limited to this and, in other words, it may have any shape including the V shape, so long as the hollow space 47 is filled with the depressed part 40.

Furthermore, it is preferable that the depressed part 40 be aligned with the lateral axis of the movable member 35.

Figure 5:
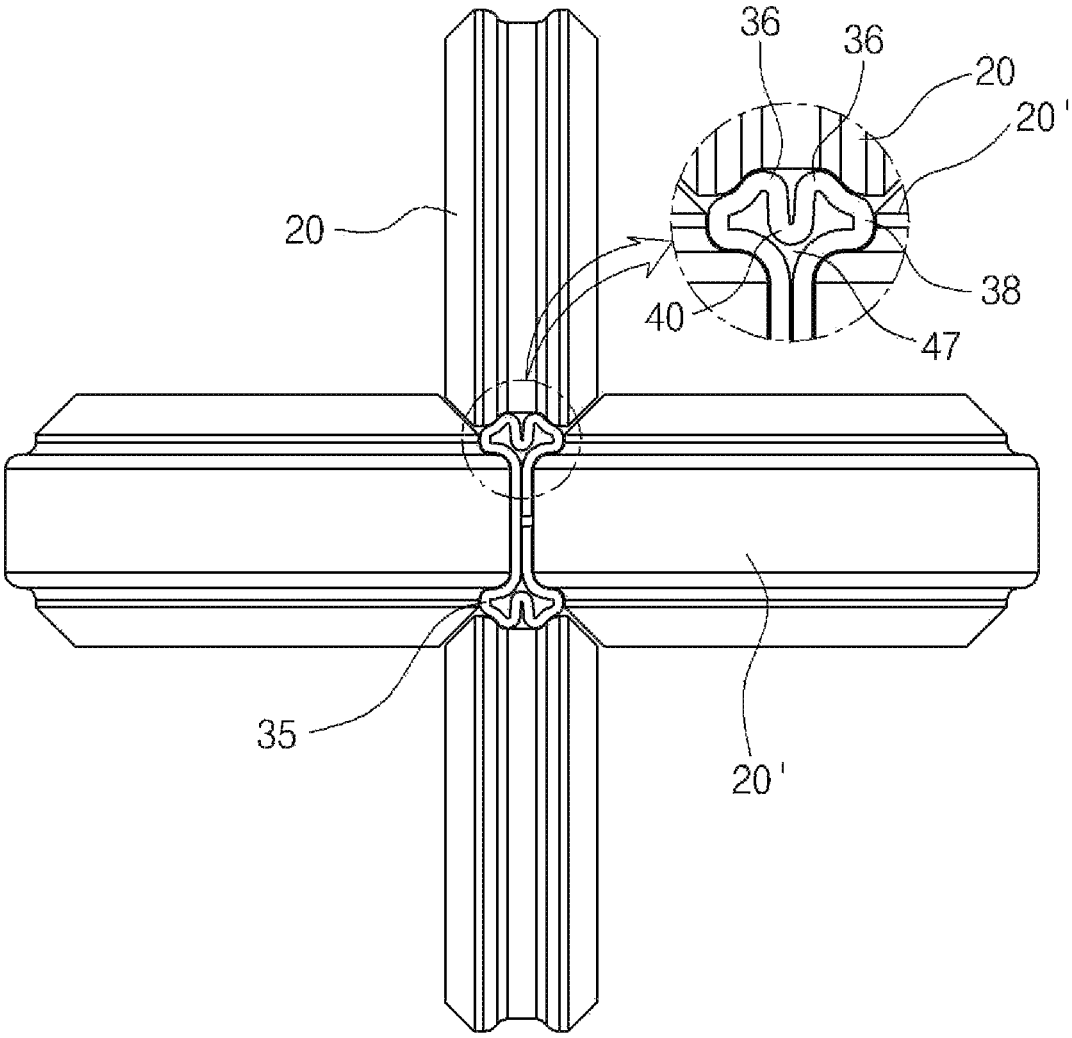
FIG. 5 is a view showing a process of roll-forming the movable member of the bottom-mounted slide according to the present invention.

As mentioned above, the bottom-mounted slide 30 of the present invention is manufactured by roll-forming in the same manner as that of the conventional technique. FIG. 5 is a sectional view showing a process of manufacturing the bottom-mounted slide 30 according to the present invention. In the bottom-mounted slide 30 according to the present invention, the depressed part 40 is formed in the medial portion of the horizontal web 36 so that the volume of the hollow space 47 formed in the movable member 35 can be minimized.

In the present invention, the depressed part 40 is formed in the horizontal web 36 by a separate process before the movable member 35 is rolled. Thereafter, the other parts of the movable member 35 are formed by rolls 20 and 20' in the same manner as that of the conventional technique. In this case, it was found that the problems, such as defective forming or imprecise measurements, can be avoided unlike the movable member of the conventional technique. The reason for this is that although compression force is applied to the webs 36 and 38 towards the hollow space 47 when the roll-forming process is conducted, the depressed part 40 withstands and absorbs the compression force.

Furthermore, it was found that when the depressed part 40 has a U-shape and is aligned with the lateral axis of the movable member 35, the depressed part 40 can effectively withstand and absorb the compression force applied to the webs 36 and 38 towards the hollow space 47.

As such, the present invention can use the roll-forming method which has been used in the conventional techniques, so that additional expenses are not required. The installation and operation of the slide 30 of the present invention are the same as those of the conventional techniques, therefore further explanation is deemed unnecessary.

In the case of the conventional wide-width style slide, the raceway part may be easily deformed towards the hollow space of the movable member by horizontal moment during the roll-forming process, so that the shape of the completed raceway part may differ from the original design. Alternatively, although the shape of the completed raceway part is the same as that of the original design, the measurements of the raceway part may not be correct and may fall outside a tolerance range. Such incorrectness in the shape or measurements of the raceway part causes a defective movable member.

However, in the bottom-mounted slide 30 of the present invention, the depressed part 40 formed in the horizontal web 36 of the movable member 35 effectively withstands and absorbs compression force applied to the movable member 35 towards the hollow space 47. Therefore, despite the fact that bottom-mounted slide 30 has a wide width, it can be prevented from deforming attributable to horizontal moment. Furthermore, the measurements of the manufactured product can be prevented from falling outside a tolerance range.

Figure 6:
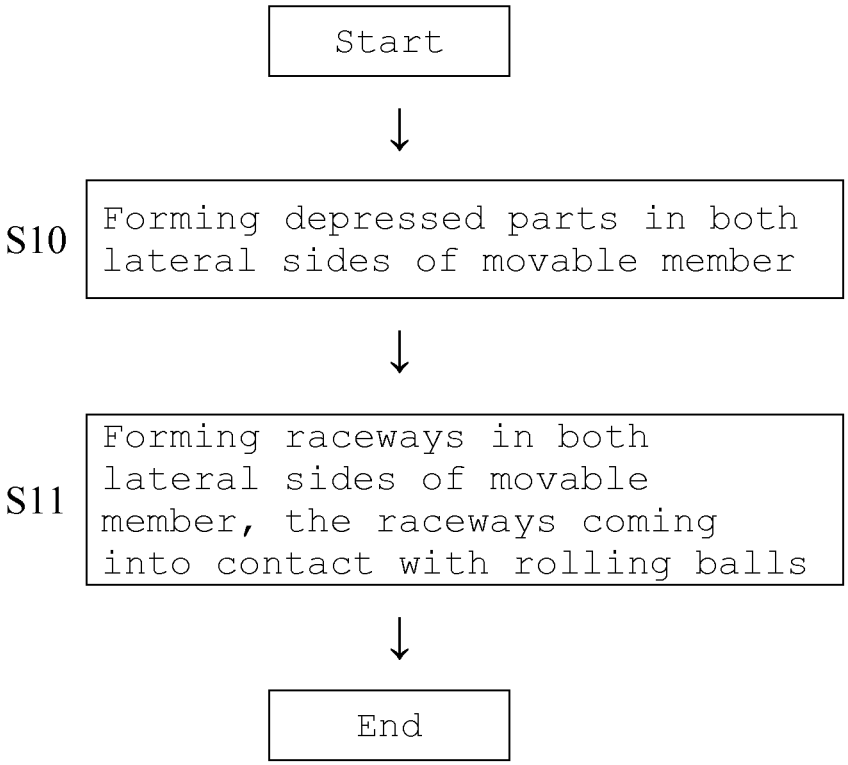
FIG. 6 is a flowchart of a method of manufacturing the movable member of the bottom-mounted slide according to the present invention.

Below a method of manufacturing the bottom-mounted slide according to the present invention will be described with reference to FIG. 6.

First, at step S10, the U-shaped depressed parts 40 are respectively formed in the predetermined portions of the lateral sides of the movable member 35 such that the hollow spaces 47 formed in the lateral sides of the movable member 35 are filled with the corresponding depressed parts 40. At step S11, the first raceways 37 which come into contact with the rolling balls 39 are formed in the lateral sides of the movable member 35. Step S11 is conducted by the same roll-forming method as that of the conventional technique. As such, the depressed parts 40 are first formed before the first raceways 37 are formed, so that the problems of defective forming or imprecise measurements can be prevented.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

As described above, the present invention provides a bottom-mounted slide which is configured such that a defective proportion of roll-forming can be reduced and the strength thereof can be enhanced so that it can be used to support a comparatively high load.

What is claimed is:

1. A bottom-mounted slide, comprising:

a movable member, with a plurality of first raceways formed in each of to opposite ends a movable member; the plurality of first raceways comprising a first pair of first raceways and a second pair of first raceways extending and being bent from the first pair of first raceways;

a pair of stationary members each of which has a first pair of second raceways facing the first pair of first raceways and a second pair of second raceways facing the second pair of first raceways, the first pair of second raceways being respectively connected to the first pair of first raceways by a corresponding first pair of balls to guide the moveable member, the second pair of second raceways being respectively connected to the second pair of first raceways by a corresponding second pair of balls to guide the moveable member, all the balls rolling along the corresponding first and second raceways;

a ball housing provided between the movable member and each of the stationary members, each ball housing supporting the balls; and wherein two depressed parts are each formed by extending and being bent from the first pair of first raceways so that each depressed part is provided in a predetermined portion of each of the opposite ends of the moveable member between the first pair of first raceways, the depressed parts each extending into a hollow space to fill the hollow space such that a volume of the hollow spaced is minimized, the hollow space being defined inside the first raceways of the corresponding end of the movable member.

2. The bottom-mounted slide as set forth in claim 1, wherein each depressed part has a U shape.

3. The bottom-mounted slide as set forth in claim 2, wherein the movable member comprises a horizontal web and a lateral web, the horizontal web being longer than the lateral web.

4. The bottom-mounted slide as set forth in claim 2, wherein the depressed part is aligned with a lateral axis of the movable member.

5. The bottom-mounted slide as set forth in claim 1, wherein the movable member comprises a horizontal web and a lateral web, the horizontal web being longer than the lateral web.

6. The bottom-mounted slide as set forth in claim 1, wherein each depressed part is aligned with an axis extending between the opposite ends of the movable member.

7. The bottom-mounted slide as set forth in claim 1, wherein the depressed part has a V shape.

8. The bottom-mounted slide as set forth in claim 1, wherein only each depressed part is positioned in each hollow space.

9. A method of manufacturing a bottom-mounted slide, comprising:

forming a moveable member with a plurality of first raceways in each of the two opposite ends of the moveable member, the plurality of first raceways comprising a first pair of first raceways a second pair of first raceways extending and being bent from the first pair of first raceways;

forming a pair of stationary members each having a first pair of second raceways facing the first pair if first raceways and a second pair of raceways facing the second pair of first raceways, the first pair of second raceways being respectively connected to the first pair of first raceways by a corresponding first pair of balls to guide the moveable member, the second pair of second raceways being respectively connected to the second pair of first raceways by a corresponding second pair of balls to guide the moveable member, all the balls rolling along the corresponding first and second raceways;

forming a ball housing between the moveable member and each of the pair of stationary members, each ball housing supporting the respective balls; and forming two respective depressed parts extending and being bent from the first pair of first raceways so that each depressed part is provided in a predetermined portion of each of the opposite ends of the moveable member between the first pair of first raceways, the depressed parts each extending into a hollow space to fill the hollow space such that a volume of the hollow space is minimized, the hollow space being defined inside the first raceways of the corresponding end of the moveable member.

10. The method as set forth in claim 9, wherein each depressed part has a U shape.

11. The method as set forth in claim 10, wherein the movable member comprises horizontal web and a lateral web, each horizontal web being longer than each lateral web.

12. The method as set forth in claim 10, wherein the forming of the pair of depressed parts comprises aligning each depressed part with an axis extending between the opposite ends of the moveable member.

13. The method as set forth in claim 9, wherein the movable member comprises horizontal web and a lateral web, each horizontal web being longer than the lateral web.

14. The method as set forth in claim 9, wherein the forming of the part of depressed parts comprises aligning the part of depressed parts with an axis extending between the opposite ends of the movable member.

15. The method as set forth in claim 14, wherein the forming of the depressed parts comprises forming the depressed parts at a medial portion between the corresponding raceways.

16. The method as set forth in claim 9, wherein each depressed part has a V shape.

17. The method as set forth in claim 9, wherein only each depressed part is positioned in each hollow space.

* * * * *